US008648582B2

(12) United States Patent
Huang et al.

(10) Patent No.: US 8,648,582 B2
(45) Date of Patent: Feb. 11, 2014

(54) PROGRAMMABLE LOW DROPOUT LINEAR REGULATOR

(75) Inventors: Chung-Hsun Huang, Tainan (TW); Ke-Ming Su, Hsinchu (TW)

(73) Assignee: National Chung Cheng University, Chia-Yi (TW)

( * ) Notice: Subject to any disclaimer, the term of this patent is extended or adjusted under 35 U.S.C. 154(b) by 312 days.

(21) Appl. No.: 12/978,946

(22) Filed: Dec. 27, 2010

(65) Prior Publication Data

US 2012/0105047 A1 May 3, 2012

(30) Foreign Application Priority Data

Oct. 29, 2010 (TW) ..... 099137386 A

(51) Int. Cl.
*G05F 1/00* (2006.01)
*G05F 3/16* (2006.01)

(52) U.S. Cl.
USPC ..... 323/281; 323/280; 323/313; 323/273

(58) Field of Classification Search
USPC ..... 323/273, 279, 280, 293, 297, 352, 353, 323/265, 369, 364; 341/121, 144, 154, 153, 341/159; 327/538, 540, 541
See application file for complete search history.

(56) References Cited

U.S. PATENT DOCUMENTS

| | | | | |
|---|---|---|---|---|
| 4,847,518 | A * | 7/1989 | Leidich | 327/541 |
| 5,315,230 | A * | 5/1994 | Cordoba et al. | 323/313 |
| 7,196,567 | B2 * | 3/2007 | Nguyen | 327/308 |
| 7,402,987 | B2 * | 7/2008 | Lopata | 323/282 |
| 7,619,402 | B1 * | 11/2009 | Kwong | 323/369 |
| 7,724,075 | B2 * | 5/2010 | Yang et al. | 327/541 |
| 7,821,321 | B2 * | 10/2010 | Zimlich | 327/513 |
| 7,834,666 | B2 * | 11/2010 | Kim | 327/102 |
| 2008/0136396 | A1 * | 6/2008 | Heilmann | 323/298 |
| 2010/0019747 | A1 * | 1/2010 | Kao et al. | 323/274 |

* cited by examiner

*Primary Examiner* — Bao Q Vu
*Assistant Examiner* — Zekre Tsehaye
(74) *Attorney, Agent, or Firm* — Wang Law Firm, Inc.; Li K. Wang; Stephen Hsu

(57) ABSTRACT

The present invention provides a programmable low dropout linear regulator using a reference voltage to convert an input voltage into a regulated voltage according to a control signal. The programmable low dropout linear regulator includes an operational amplifier having a negative input coupled to receive the reference voltage, a first transistor having a gate coupled to an output terminal of the operational amplifier and a first source/drain coupled to an output terminal of the regulated voltage, a first impedance coupled between a positive input of the operational amplifier and the output terminal of the regulated voltage, and a second impedance coupled between the positive input of the operational amplifier and a ground. The second impedance includes a second transistor having a gate coupled to receive the control signal.

6 Claims, 11 Drawing Sheets

PROGRAMMABLE LOW DROPOUT LINEAR REGULATOR

BACKGROUND OF THE INVENTION

1. Field of the Invention

The exemplary embodiment(s) of the present invention relates to a field of linear regulator. More specifically, the exemplary embodiment(s) of the present invention relates to a programmable low dropout linear regulator using a feedback network of active load.

2. Description of Related Art

Power supplies provide necessary power consumption for the operation of electronic systems. The source of power may be a battery or a supply circuit. An unregulated power source is not able to supply power stable enough for circuits or systems having strict requirement of power supply. The unregulated power source will adversely affect the circuit or system performance and even result in malfunction, which degrades the reliability of the system or circuit. Moreover, power conversion is needed for a system or circuit with portions requiring a supply voltage having a level different from that provided by the power source. This also necessitates a voltage regulator or DC-DC converter for conversion of the unregulated supply voltage into a regulated one having a required level.

Voltage regulators are mainly categorized in switching regulators and linear regulators. Switch regulators are advantageous in having an adjustable output voltage level and high power efficiency where a large difference between the input and output voltage level exists, but disadvantageous in having large ripples and noise in the output voltage. On the contrary, in comparison with the switching regulators, the linear regulators have smaller ripples and noise, but lower power efficiency in case of large input-output voltage difference. Therefore, the linear regulators are typically used as LDOs (low dropout linear regulators) where the input-output voltage difference is limited. Conventionally, a combination of the switching and linear regulator is used in high dropout conversion, wherein the switching regulator converts the voltage level while the linear regulator performs regulation of the voltage output from the switching regulator to diminish the ripples and noise therein.

With the rising of the environmental awareness of the public, and rapid development and population of electronic products, low power consumption and high power efficiency become a critical consideration in electronic product design. Systems or circuits power supplied by batteries should be operated with a low voltage/current to reduce the power consumption and extend battery life. Even those supplied by utility power usually include circuits for power management so that they can be operated with low voltage in saving or standby mode when being idle for a period of time. Moreover, with the development of nano-CMOS manufacturing technologies, the operating voltages of integrated circuits are decreasing. Thus, modern system or circuits should be usually designed to operate with a low operating voltage. Circuits operating in a low voltage have a strict requirement of power supply in order to perform adequately, and accordingly the linear regulator is a key component in a low voltage system. The advantages of an LDO include:

(1) low noise and ripple in the output voltage;
(2) better transient response to changes of the load current and input voltage;
(3) low EMI;
(4) low static current, low power consumption and high power efficiency;

(5) simple circuitry and small circuit area; and
(6) no discrete inductor used, which helps to reduce an area of the system board and product cost.

The advantages mentioned above are basic requirements of a system with a low power consumption, low voltage and low cost. Additionally, to reduce the power consumption more effectively, the functional block in a SOC (system on chip) may have multiple operation modes using different operating voltages, which is a kind of circuit design so called "Multi-Voltage Domain" and necessitates a multi-level power supply. Moreover, in consideration of both system performance and power consumption, the SOC always includes a power management mechanism able to alter the operating voltage or even turn off the power supply, depending on the requirements of the operation modes and performance. In such a case, a programmable DC power supply is necessary for the system to meet the voltage specifications in different operation modes.

Although a switching regulator is inherently a programmable DC power supply, due to its disadvantages mentioned above, the simplest and most straightforward implementation of a programmable DC power supply for a system with a low power consumption, low voltage and low cost is the combination of multiple LDOs with a multiplexer selecting a desired output from those of the LDOs as shown in FIG. 1A. Alternatively, a single LDO using multiple reference voltage generators to generate output voltages with multiple levels may be also appropriate, as shown in FIG. 1B. However, any one of the circuits shown in FIGS. 1A and 1B will occupy a relatively large chip area.

Alternatively, in order to reduce the circuit area, a programmable reference voltage generator may be used, as shown in FIG. 2. However, the circuit complexity and accuracy issue of the programmable reference voltage generator, and a high common mode voltage level of the error amplifier resulting from the alteration of the reference voltage increases the difficulty of circuit design.

There have been some studies proposing to have different output voltage levels by altering the resistance of the feedback network, as shown in FIG. 3. The relationship between the levels of the output and input voltages can be indicated by:

$$Vout=Vref(1+R1/R2) \quad (1)$$

The desired output voltage level can be obtained by changing the ratio of R1 to R2. However, in case that a large number of output voltage levels are required, a large number of resistors are necessary. Although the resistors may be implemented by discrete resistors to diminish the impact of inconsistency of process parameters and temperature dependency, such an implementation can not meet the requirement of an embedded power management and departs from the SOC design. This necessitates programmable resistor strings integrated on a single chip. The programmable resistor strings will include a large number of resistors which occupy a large circuit area and therefore increase the cost. The circuit area of the programmable resistor string may be even larger than that of an LDO.

SUMMARY OF THE INVENTION

A programmable low dropout linear regulator is disclosed. The programmable low dropout linear regulator using a reference voltage to convert an input voltage into a regulated voltage according to a first control signal includes an operational amplifier having a negative input coupled to receive the reference voltage, a first transistor having a gate coupled to an output terminal of the operational amplifier and a first source/ drain coupled to an output terminal of the regulated voltage, a first impedance coupled between a positive input of the operational amplifier and the output terminal of the regulated voltage, and a second impedance coupled between the positive input of the operational amplifier and a ground. The second impedance includes a second transistor having a gate coupled to receive the first control signal.

Another programmable low dropout linear regulator is also disclosed. The programmable low dropout linear regulator using a reference voltage to convert an input voltage into a regulated voltage according to a plurality of first control signals, the programmable low dropout linear regulator comprises an operational amplifier having a negative input coupled to receive the reference voltage, a first transistor having a gate coupled to an output terminal of the operational amplifier and a first source/drain coupled to an output terminal of the regulated voltage, a first impedance coupled between a positive input of the operational amplifier and the output terminal of the regulated voltage, and a second impedance coupled between the positive input of the operational amplifier and a ground, wherein the second impedance comprises a plurality of second transistors each having a gate coupled to receive each of said first control signals.

With these and other objects, advantages, and features of the invention that may become hereinafter apparent, the nature of the invention may be more clearly understood by reference to the detailed description of the invention, the embodiments and to the several drawings herein.

BRIEF DESCRIPTION OF THE DRAWINGS

The exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PREFERRED EMBODIMENTS

Exemplary embodiments of the present invention are described herein in the context of a programmable low dropout linear regulator.

Those of ordinary skilled in the art will realize that the following detailed description of the exemplary embodiment(s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

In accordance with the embodiment(s) of the present invention, the components, process steps, and/or data structures described herein may be implemented using various types of operating systems, computing platforms, computer programs, and/or general purpose machines. In addition, those of ordinary skill in the art will recognize that devices of a less general purpose nature, such as hardwired devices, field programmable gate arrays (FPGAs), application specific integrated circuits (ASICs), or the like, may also be used without departing from the scope and spirit of the inventive concepts disclosed herein. Where a method comprising a series of process steps is implemented by a computer or a machine and those process steps can be stored as a series of instructions readable by the machine, they may be stored on a tangible medium such as a computer memory device (e.g., ROM (Read Only Memory), PROM (Programmable Read Only Memory), EEPROM (Electrically Erasable Programmable Read Only Memory), FLASH Memory, Jump Drive, and the like), magnetic storage medium (e.g., tape, magnetic disk drive, and the like), optical storage medium (e.g., CD-ROM, DVD-ROM, paper card and paper tape, and the like) and other known types of program memory.

Figure 1A:
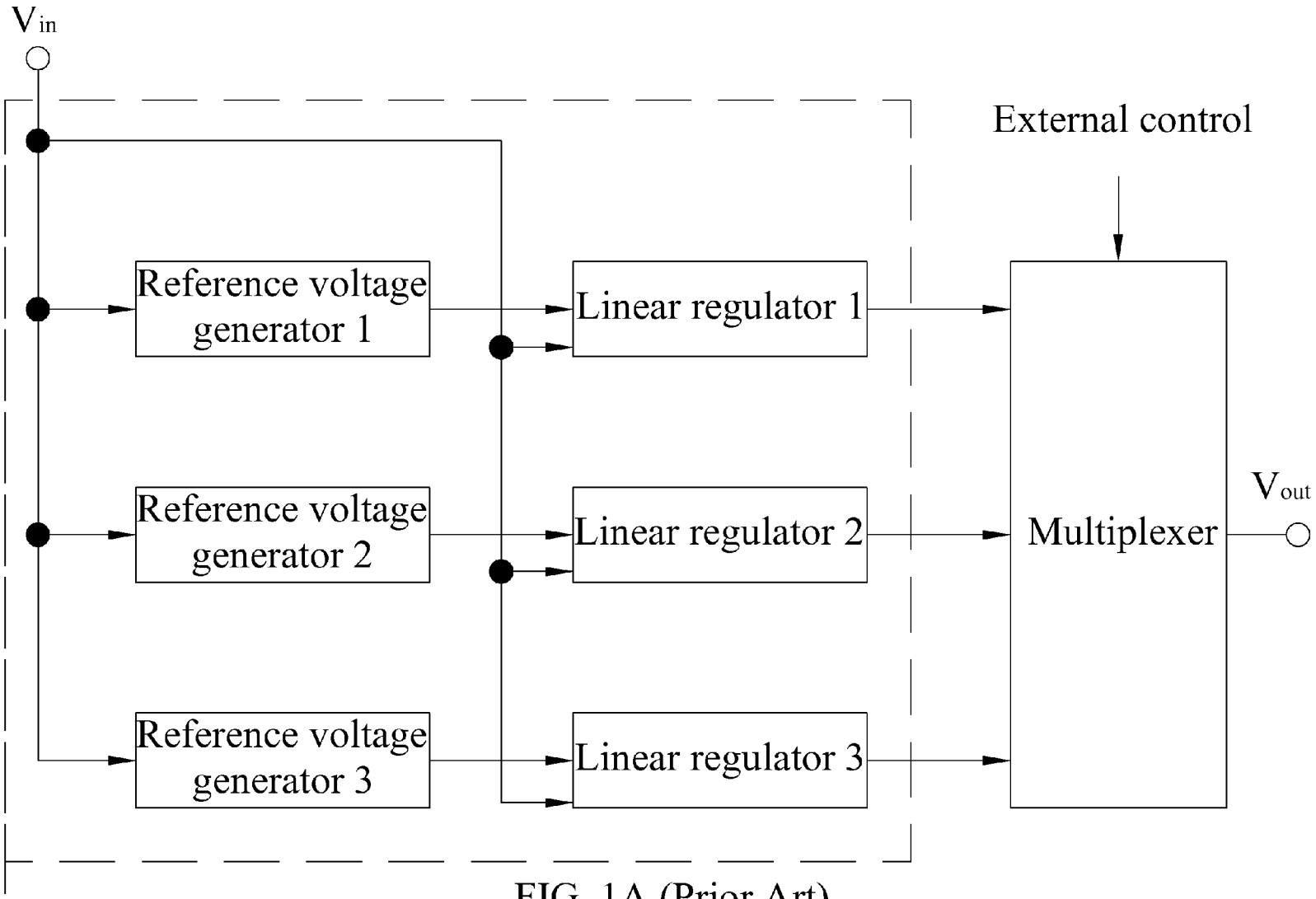
FIG. 1A (Prior Art)
FIG. 1A illustrates a schematic diagram of a traditional low dropout linear regulator generating one of multiple regulated voltage selected by a multiplexer.
Figure 1B:
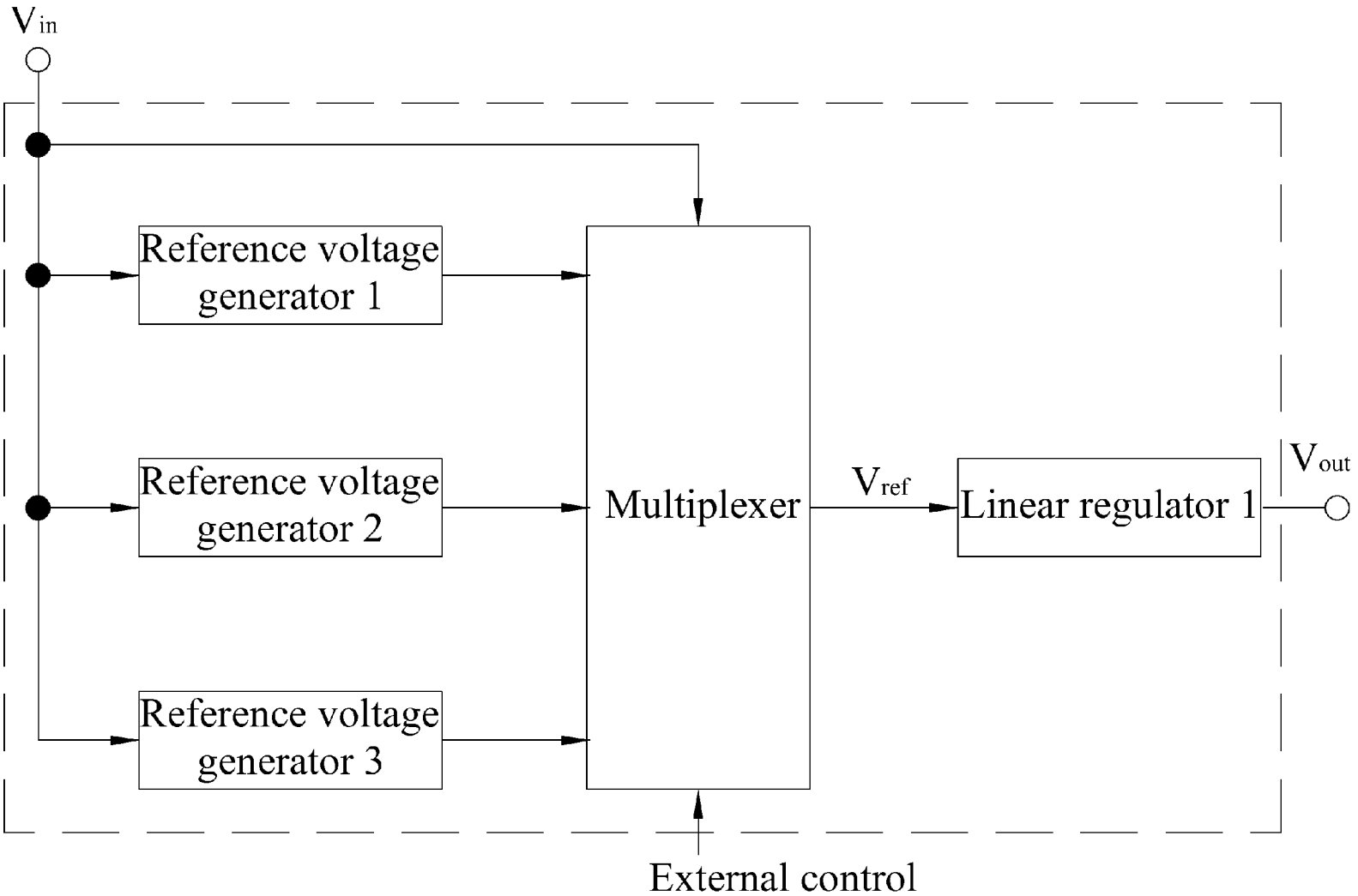
FIG. 1B (Prior Art)
FIG. 1B illustrates a schematic diagram of a traditional low dropout linear regulator using one of multiple reference voltage selected by a multiplexer.
Figure 2:
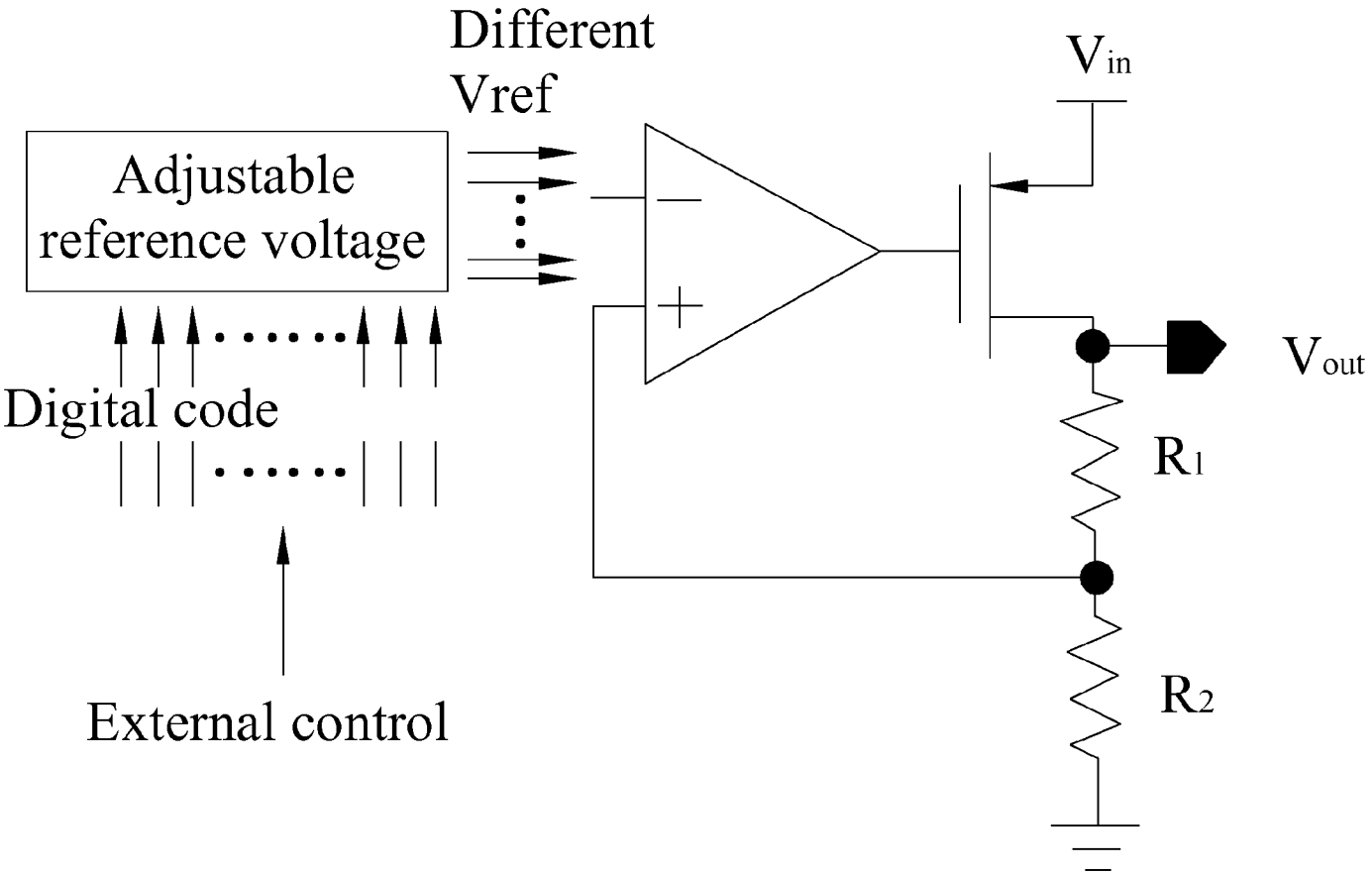
FIG. 2 (Prior Art)
FIG. 2 illustrates a schematic diagram of a traditional low dropout linear regulator using a programmable reference voltage generator.
Figure 3:
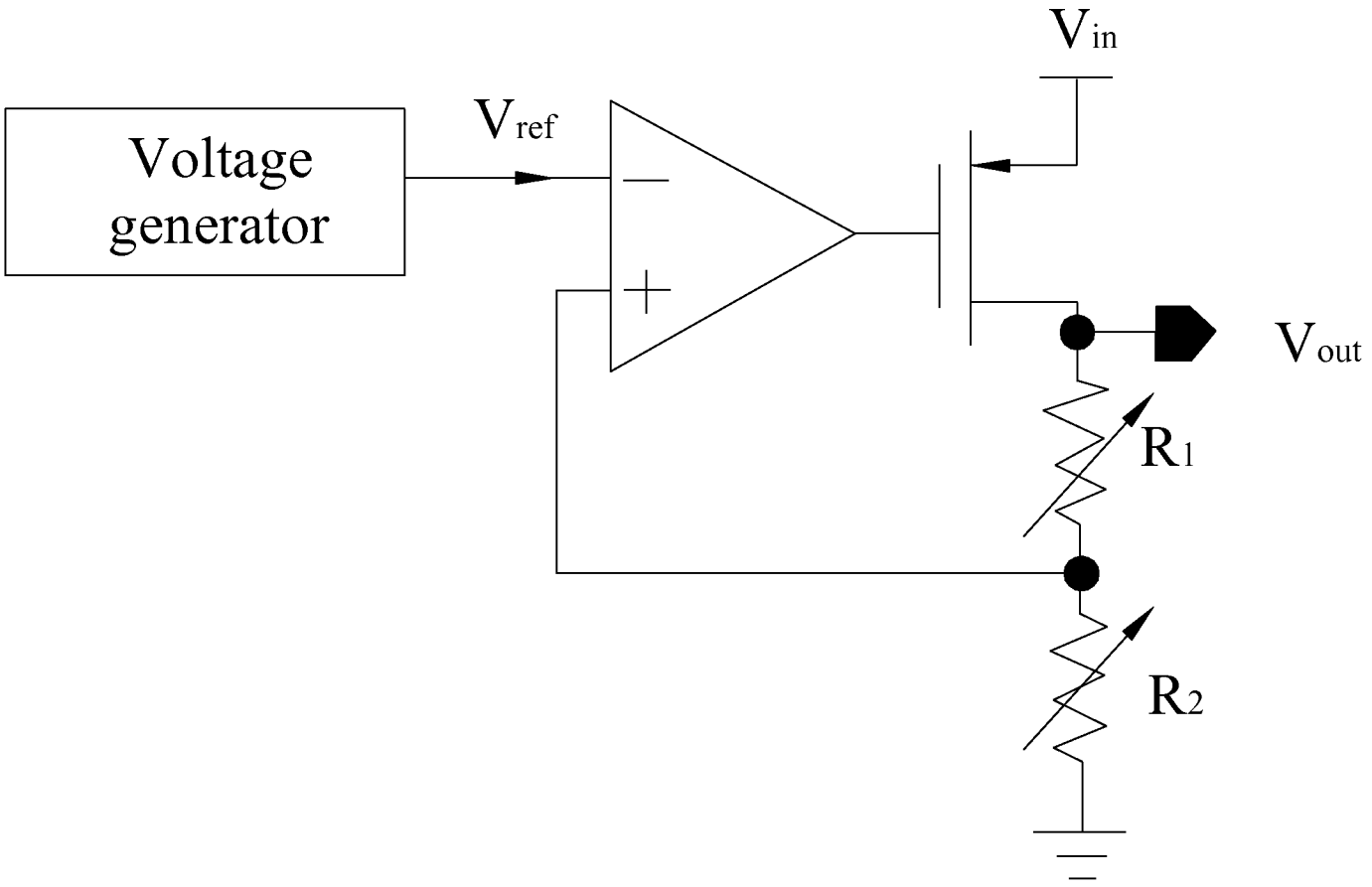
FIG. 3 (Prior Art)
FIG. 3 illustrates a schematic diagram of a traditional low dropout linear regulator using a feedback network of passive load.
Figure 4:
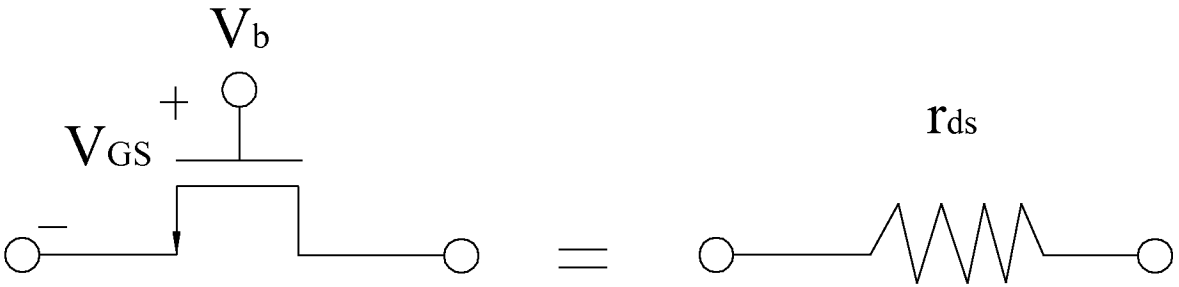
FIG. 4 illustrates a schematic diagram of a programmable low dropout linear regulator using a feedback network of active load according to one embodiment of the invention.

FIG. 4 illustrates an active load implemented by a MOSFET, wherein the equivalent resistance of the MOSFET may be varied upon the level of the voltage (Vb) applied on its gate, as indicated by the equation (2):

$$r_{ds}=1/\mu C_{ox}(W/L)(V_{GS-VT}) \quad (2)$$

where μ represents the surface-channel mobility, Cox represents the parasitic capacitance of the gate oxide per cell, W/L is the ratio of width to length of the channel and $V_T$ is the threshold voltage.

Figure 5A:
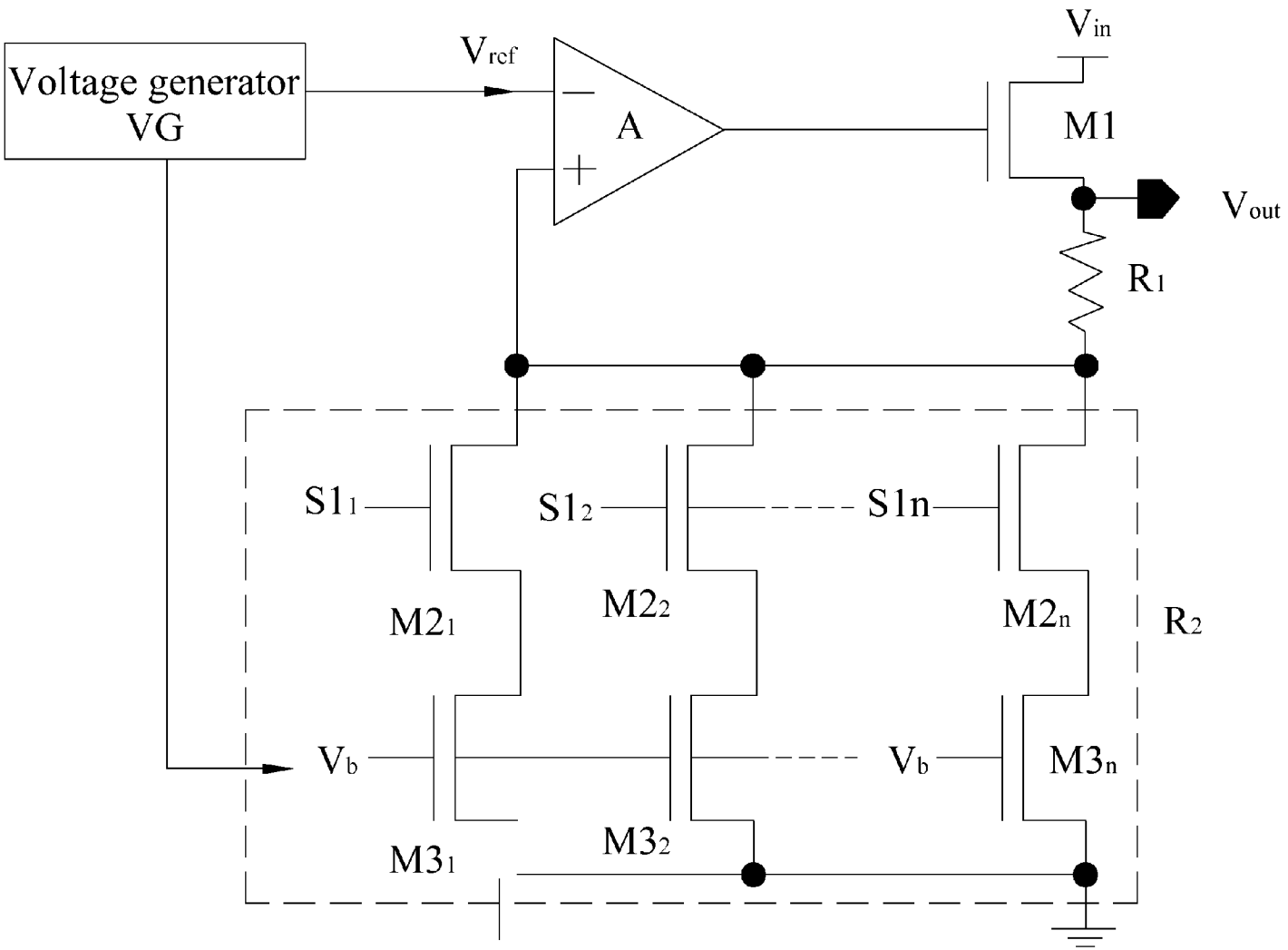
FIG. 5A illustrates a schematic diagram of a programmable low dropout linear regulator according to a first embodiment of the invention.

FIG. 5A shows a programmable low dropout linear regulator using the active load shown in FIG. 4 according to a first embodiment of the invention. The low dropout linear regulator converts an input voltage $V_{in}$, into a regulated voltage $V_{out}$ using a reference voltage $V_{ref}$ in response to control signals $S1_1$~$S1_n$. The low dropout linear regulator includes a voltage generator VG, operational amplifier A, a transistor M1, and resistors R1 and R2. The operational amplifier A has a negative input coupled to receive the reference voltage $V_{ref}$. The transistor M1 has a gate coupled to an output terminal of the operational amplifier A and a first source/drain coupled to an output terminal of the regulated voltage $V_{out}$. The impedance R1 is coupled between a positive input of the operational amplifier A and the output terminal of the regulated voltage $V_{ref}$. The impedance R2 is coupled between the positive input of the operational amplifier A and a ground. Specifically, the impedance R2 includes multiple transistors $M2_1$~$M2_n$ each having a gate coupled to receive one of the control signals $S1_1$~$S1_n$. A first source/drain of each of the transistors $M2_1$~$M2_n$ is coupled to the positive input of the operational amplifier A. The impedance R2 further includes multiple transistors $M3_1$~$M3_n$ each having a first source/drain coupled to a second source/drain of one of the transistors $M2_1$~$M2_n$ and a second source/drain coupled to the ground. The gates of the transistors $M3_1$~$M3_n$ are coupled to receive a bias voltage $V_b$ which is generated by the voltage generator VG.

In the programmable low dropout linear regulator shown in FIG. 5A, the active loads are activated in response to the control signals $S1_1$~$S1_n$, which determines the ratio of R1 to R2 as well as the level of the regulated voltage $V_{out}$. Moreover, in order to obtain a desired level of the regulated voltage precisely, the feedback network of the active loads is implemented by transistor strings connected in parallel so that there are sufficient number of choices of the output voltage level. In comparison with the conventional low dropout linear regulator using a feedback network of passive loads, the programmable low dropout linear regulator of this embodiment has a much smaller circuit area.

Figure 5B:
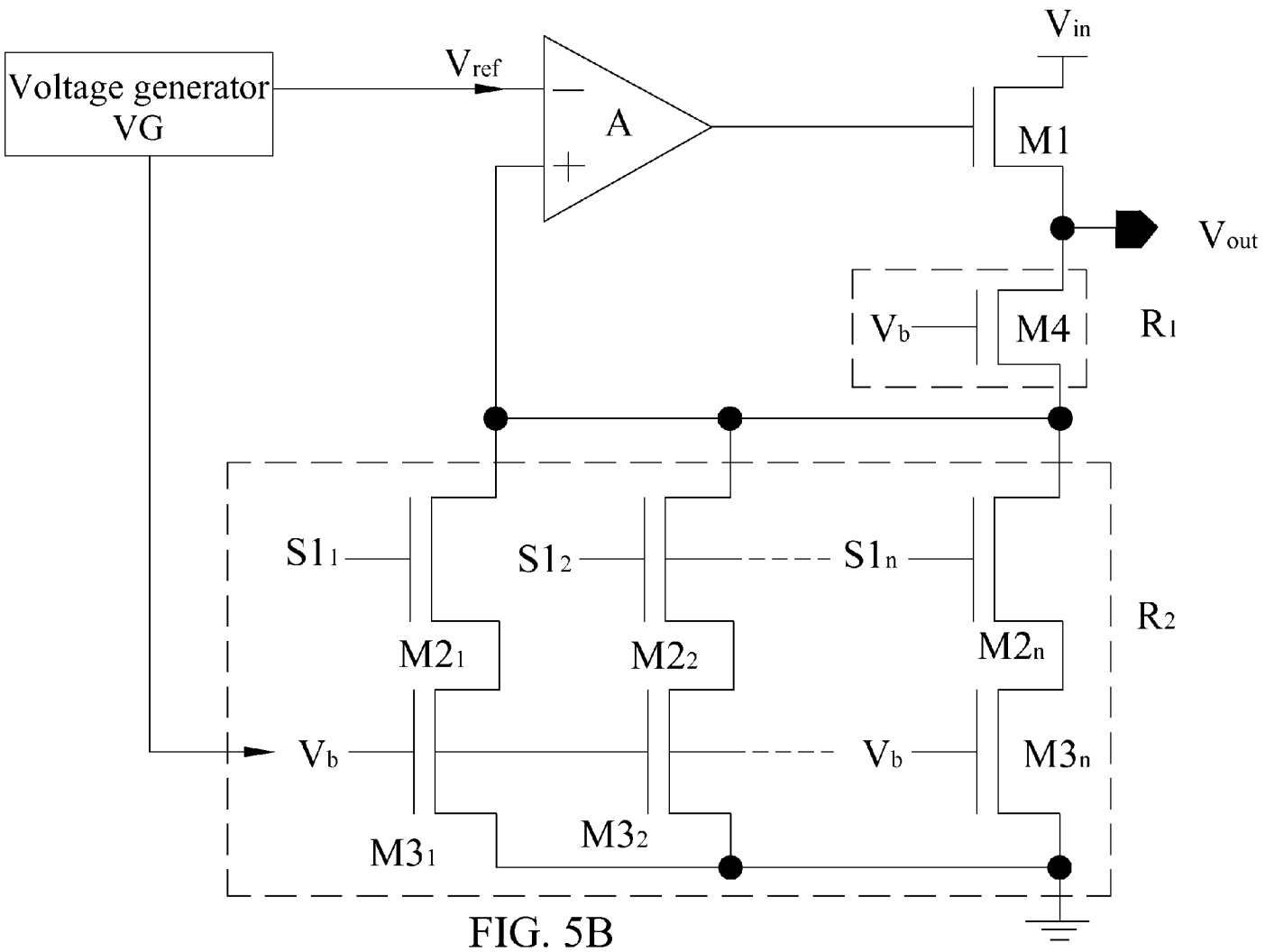
FIG. 5B illustrates a schematic diagram of a programmable low dropout linear regulator according to a second embodiment of the invention.

FIG. 5B shows a programmable low dropout linear regulator according to a second embodiment of the invention. The programmable low dropout linear regulator of FIG. 5B is similar to that of FIG. 5A except that its impedance R1 is also implemented by active loads. The impedance R1 includes a transistor M4 having a first source/drain coupled to the output terminal of the regulated voltage $V_{out}$, a second source/drain coupled to the positive input of the operational amplifier A, and a gate coupled to receive a bias voltage $V_b$. This circuit design diminishes the impact of ambient factors on the level of the regulated voltage $V_{out}$. The bias voltage $V_b$ will vary with the ambient temperature. The variation of bias voltage $V_b$ will then cause a variation of the equivalent resistances of the active loads and accordingly the ratio of R1 to R2. However, since the transistors implementing the active loads are physically disposed near to each other, they are both subject to similar ambient factors so that there is nearly no impact on the ratio of R1 to R2.

Figure 5C:
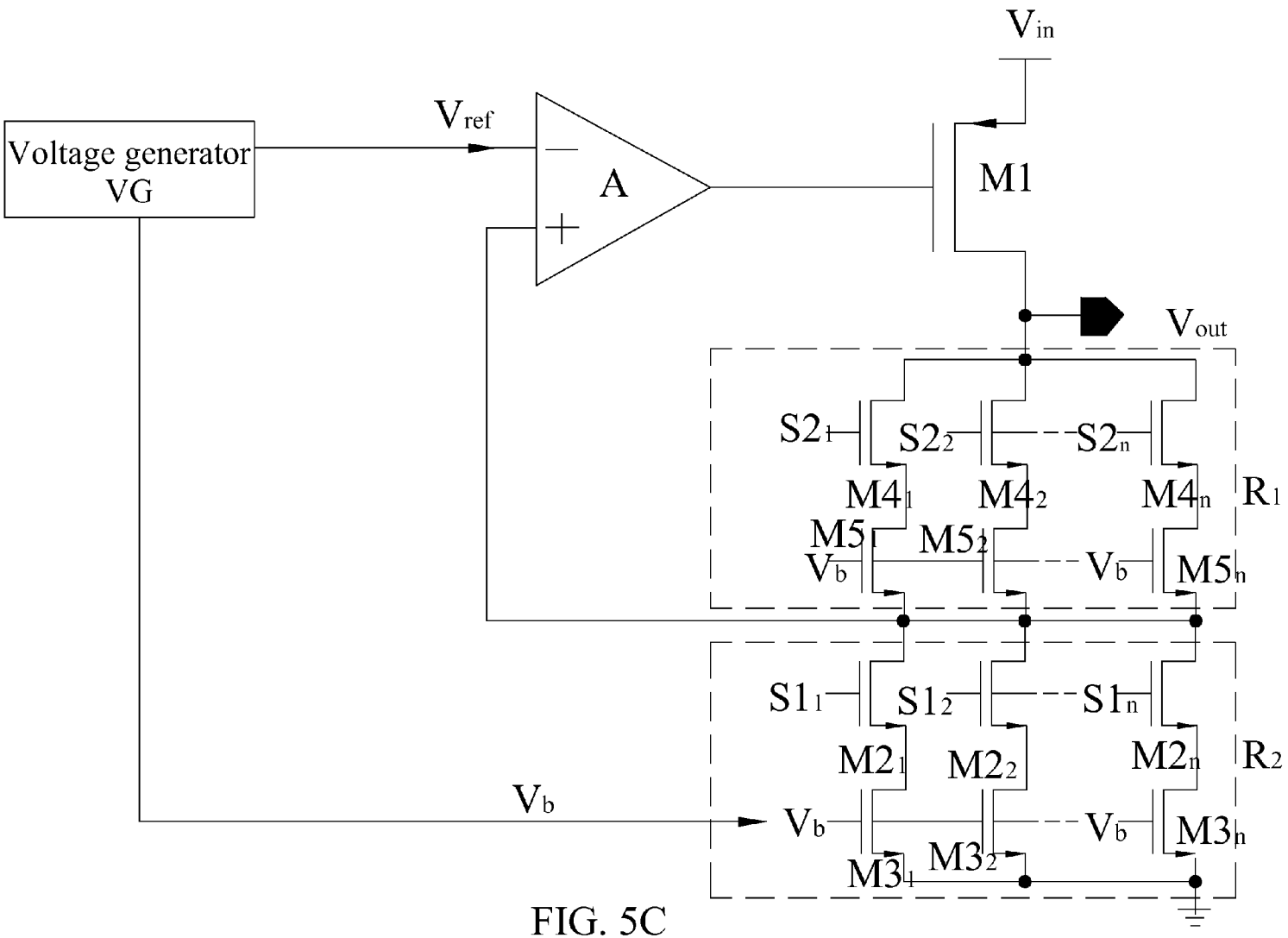
FIG. 5C illustrates a schematic diagram of a programmable low dropout linear regulator according to a third embodiment of the invention.

Alternatively, under practical considerations or demands, both impedances R1 and R2 may be implemented by active loads, as shown in FIG. 5C. In the programmable low dropout linear regulator of FIG. 5C, the impedance R1 includes transistors $M4_1$~$M4_n$ each having a gate coupled to receive one of control signals $S2_1$~$S2_n$. A first source/drain of each of the transistors $M4_1$~$M4_n$ is coupled to the output terminal of the regulated voltage $V_{out}$. The impedance R1 further includes transistors $M5_1$~$M5_n$ each having a first source/drain coupled to a second source/drain of one of the transistors $M4_1$~$M4_n$, a second source/drain coupled to the positive input of the operational amplifier A, and a gate coupled to receive the bias voltage $V_b$. Thus, there are a relatively large number of choices of the level of the regulated voltage $V_{out}$ through the control signals $S1_1$~$S1_n$ and $S2_1$~$S2_n$.

Figure 6:
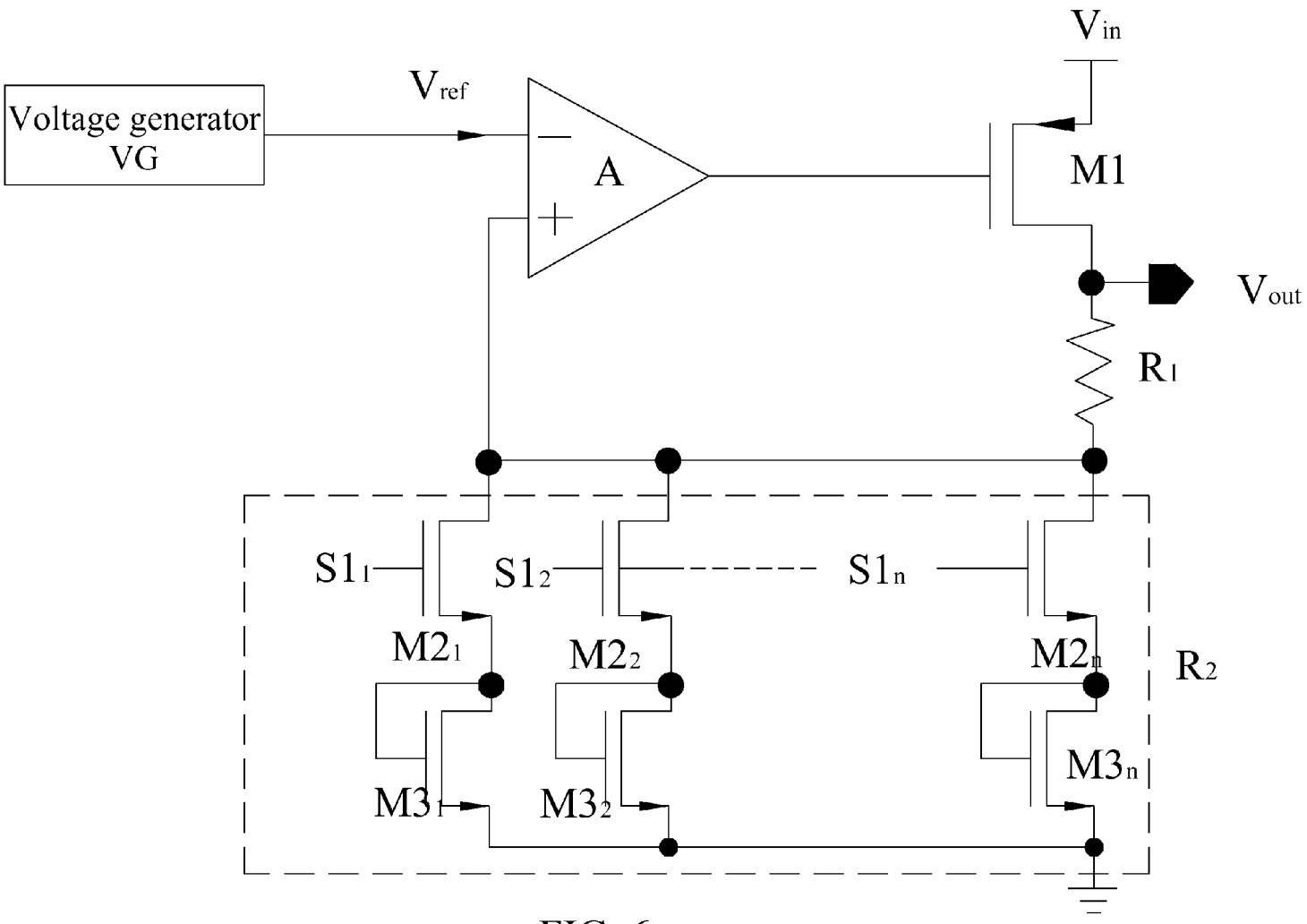
FIG. 6 illustrates a schematic diagram of a programmable low dropout linear regulator according to a fourth embodiment of the invention.

The active load may be alternatively implemented by a diode-connected MOSFET. FIG. 6 illustrates a schematic diagram of a programmable low dropout linear regulator according to a fourth embodiment of the invention. The programmable low dropout linear regulator of FIG. 6 is similar to that of FIG. 5A except that each of the transistors $M3_1$~$M3_n$ has a gate coupled to one of its sources/drains. The diode-connected transistors $M3_1$~$M3_n$ will operate in the cutoff or saturation region. The diode-connected transistors $M3_1$~$M3_n$ are coupled to the output terminal of the regulated voltage $V_{out}$ and self-biased to have expected equivalent resistances when being turned on by the control signals $S1_1$~$S1_n$. Thus, there is no need for additional circuit for generation of the bias voltage. Such a self-generated bias voltage is more stable than that of the circuit shown in FIG. 5A which is generated by the voltage generator VG.

Figure 7A:
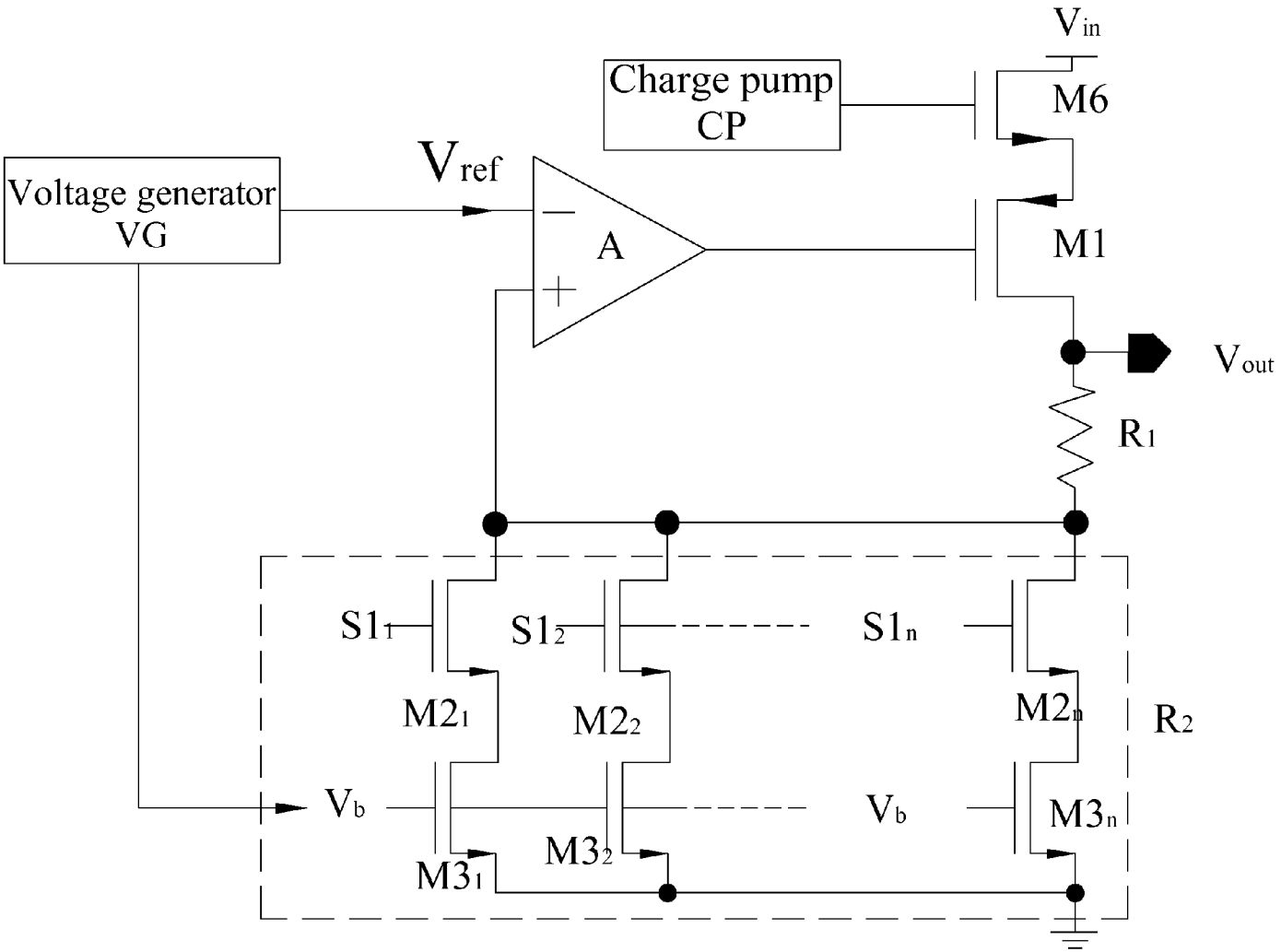
FIG. 7A illustrates a schematic diagram of a programmable low dropout linear regulator according to a fifth embodiment of the invention.
Figure 7B:
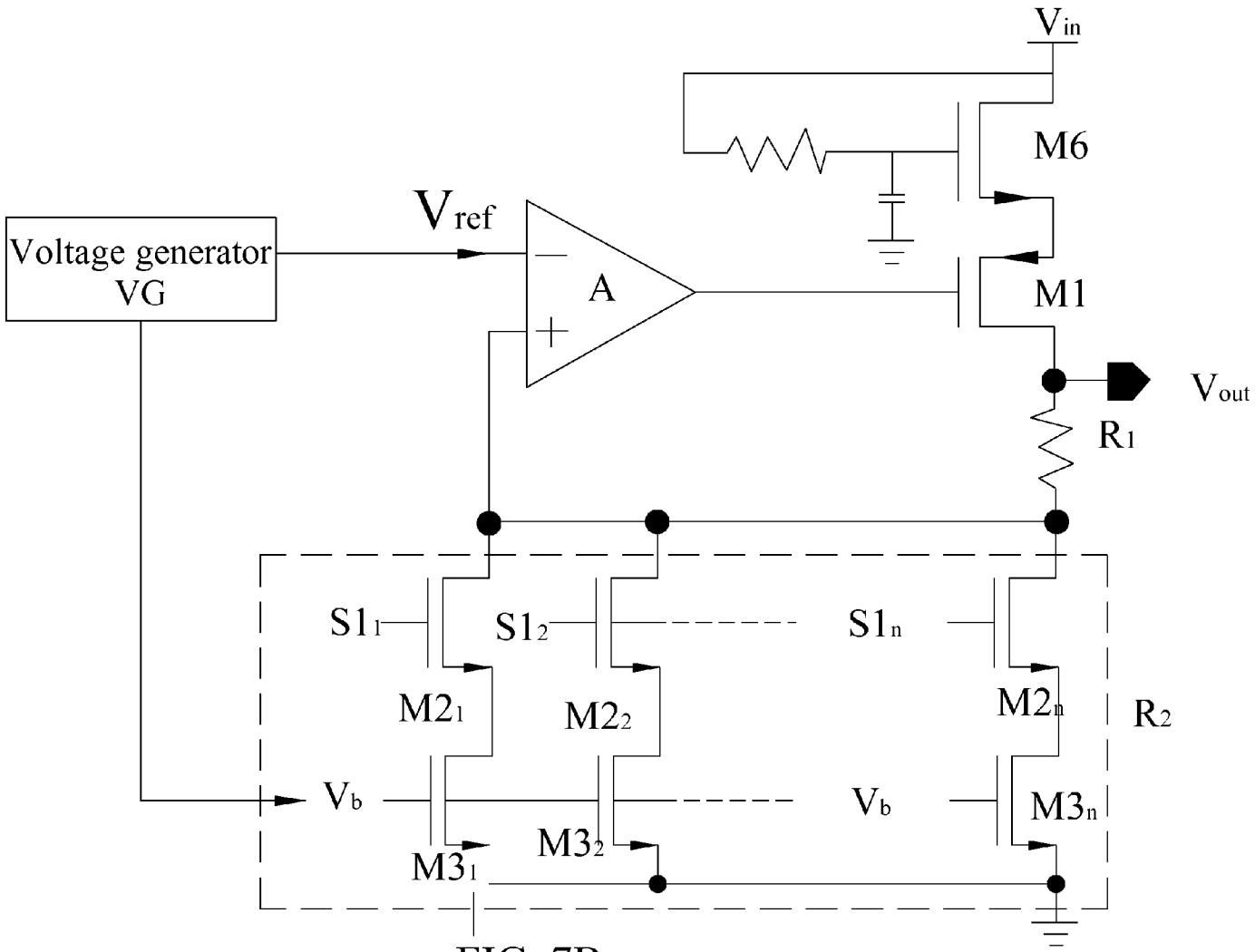
FIG. 7B illustrates a schematic diagram of a programmable low dropout linear regulator according to a sixth embodiment of the invention.

More specifically, an additional transistor may be cascaded to the power transistor M1 for a higher PSRR (Power Supply Rejection Ratio). FIG. 7A illustrates a schematic diagram of a programmable low dropout linear regulator according to a fifth embodiment of the invention. The programmable low dropout linear regulator of FIG. 7A is similar to that of FIG. 5A except that it includes a transistor M6. The transistor M6 has a gate coupled to a charge pump CP, a first source/drain coupled to receive the input voltage $V_{in}$, and a second source/drain coupled to a source/drain of the transistor M1. FIG. 7B illustrates a schematic diagram of a programmable low dropout linear regulator according to a sixth embodiment of the invention. The programmable low dropout linear regulator of FIG. 7B is similar to that of FIG. 7A except that the gate of the transistor M6 is coupled to an RC filter rather than the charge pump CP. A capacitor is coupled between the gate of the transistor M6 and the ground, and a resistor is coupled between the gate and the source/drain of the transistor M6. The transistor M6 in FIGS. 7A and 7B may be also included in other embodiments mentioned above.

In conclusion, the conventional low dropout linear regulator is disadvantageous in having a large circuit area and great complexity resulting from the generation of the bias voltage of the operational amplifier. The present invention provides a programmable low dropout linear regulator using a feedback network of active loads, which is superiors in having a small circuit area, low power consumption and circuit simplicity. Moreover, the inventive programmable low dropout linear regulator may apply to power management of SOC chips and be helpful in enhancing the performance of the whole system.

While particular embodiments of the present invention have been shown and described, it will be obvious to those skilled in the art that, based upon the teachings herein, changes and modifications may be made without departing from this invention and its broader aspects. Therefore, the appended claims are intended to encompass within their scope of all such changes and modifications as are within the true spirit and scope of the exemplary embodiment(s) of the present invention.

What is claimed is:

1. A programmable low dropout linear regulator using a reference voltage to convert an input voltage into a regulated voltage according to a first control signal, the programmable low dropout linear regulator comprising:

an operational amplifier having a negative input coupled to receive the reference voltage;

a first transistor having a gate coupled to an output terminal of the operational amplifier and a first source/drain coupled to an output terminal of the regulated voltage;

a first impedance coupled between a positive input of the operational amplifier and the output terminal of the regulated voltage; and a second impedance coupled between the positive input of the operational amplifier and a ground;

wherein the second impedance is consisting of a second transistor and a third transistor, the second transistor has a gate coupled to receive the first control signal, a first source/drain of the second transistor is directly coupled to the positive input of the operational amplifier, a first source/drain of the third transistor is directly coupled to a second source/drain of the second transistor, and a second source/drain of the third transistor is directly coupled to the ground;

wherein the first impedance is consisting of a fourth transistor and a fifth transistor, the fourth transistor has a gate coupled to receive a second control signal, a first source/drain of the fourth transistor is directly coupled to the output terminal of the regulated voltage, the fifth transistor has a first source/drain directly coupled to a second source/drain of the fourth transistor and a second source/drain directly coupled to the positive input of the operational amplifier.

2. The programmable low dropout linear regulator of claim 1, wherein a second source/drain of the first transistor is coupled to receive the input voltage.

3. The programmable low dropout linear regulator of claim 1 further comprising a sixth transistor having a first source/drain coupled to receive the input voltage and a second source/drain coupled to a second source/drain of the first transistor.

4. A programmable low dropout linear regulator using a reference voltage to convert an input voltage into a regulated voltage according to a plurality of first control signals, the programmable low dropout linear regulator comprising:

an operational amplifier having a negative input coupled to receive the reference voltage;

a first transistor having a gate coupled to an output terminal of the operational amplifier and a first source/drain coupled to an output terminal of the regulated voltage;

a first impedance coupled between a positive input of the operational amplifier and the output terminal of the regulated voltage; and a second impedance coupled between the positive input of the operational amplifier and a ground;

wherein the second impedance is consisting of a plurality of second transistors and a plurality of third transistors, each of the second transistors has a gate coupled to receive each of said first control signals, a first source/drain of each of the second transistors is directly coupled to the positive input of the operational amplifier, a first source/drain of each of the third transistors is directly coupled to a second source/drain of one of the second transistors, and a second source/drain of each of the third transistors is directly coupled to the ground;

wherein the first impedance is consisting of a plurality of fourth transistors and a plurality of fifth transistors, each of the fourth transistors has a gate coupled to receive a second control signal, a first source/drain of each of the fourth transistors is directly coupled to the output terminal of the regulated voltage, each of the fifth transistors has a first source/drain directly coupled to a second source/drain of one of the fourth transistors and a second source/drain directly coupled to the positive input of the operational amplifier.

5. The programmable low dropout linear regulator of claim 4, wherein a second source/drain of the first transistor is coupled to receive the input voltage.

6. The programmable low dropout linear regulator of claim 4 further comprising a sixth transistor having a first source/drain coupled to receive the input voltage and a second source/drain coupled to a second source/drain of the first transistor.

* * * * *